United States Patent [19]

Liu et al.

[11] 4,144,059

[45] Mar. 13, 1979

[54] DUCTILE LONG RANGE ORDERED ALLOYS WITH HIGH CRITICAL ORDERING TEMPERATURE AND WROUGHT ARTICLES FABRICATED THEREFROM

[75] Inventors: Chain T. Liu; Henry Inouye, both of Oak Ridge, Tenn.

[73] Assignee: The United States of America as represented by the United States Department of Energy, Washington, D.C.

[21] Appl. No.: 886,379

[22] Filed: Mar. 14, 1978

[51] Int. Cl.[2] ..... C22C 19/00

[52] U.S. Cl. ..... 75/170; 75/122; 75/134 F; 75/134 V; 148/11.5 N; 148/11.5 R; 148/31; 148/32

[58] Field of Search ..... 75/170, 134 F, 134 V, 75/128 V, 122; 148/11.5 R, 11.5 N, 31, 32

[56] References Cited

U.S. PATENT DOCUMENTS

| | | | |
|---|---|---|---|
| 3,422,407 | 1/1969 | Gould et al. | 340/174 |
| 3,832,243 | 8/1974 | Donkersloot et al. | 148/32 |
| 3,898,081 | 8/1975 | Kukhar | 75/171 |

OTHER PUBLICATIONS

Van Vucht, " . . . Intermetallic Compds. of the $AB_3$ Type", J. Less-Common Metals, 11 (1966),308.

Sinha, " . . . $AB_3$ Structure in . . . Transition Metals", Trans AIME, 245 (1969), 911.

Liu, " . . . Transformations in V—Co—Ni . . . Alloys", Met. Transactions, 4 (1973), 1943.

Stoloff, "Mech. Properties of Ordered Alloys", Progress in Materials Science, vol. 13, Pergamom, 1966.

Liu et al., ". . . Mech. Properties of V—Co—Ni . . . Alloys", 2nd Intn. Conf. on Strength of Materials & Alloys, Sep. 1970, ASM.

*Primary Examiner*—R. Dean

*Assistant Examiner*—Upendra Roy

*Attorney, Agent, or Firm*—Dean E. Carlson; Stephen D. Hamel; Allen H. Uzzell

[57] ABSTRACT

Malleable long range ordered alloys having high critical ordering temperatures exist in the $V(Fe, Co)_3$ and $V(Fe, Co, Ni)_3$ systems. These alloys have the following compositions comprising by weight: 22–23% V, 14–30% Fe, and the remainder Co or Co and Ni with an electron density no more than 7.85. The maximum combination of high temperature strength, ductility and creep resistance are manifested in the alloy comprising by weight 22–23% V, 14–20% Fe and the remainder Co and having an atomic composition of $V(Fe_{0.20-0.26}\,C\,Co_{0.74-0.80})_3$. The alloy comprising by weight 22–23% V, 16–17% Fe and 60–62% Co has excellent high temperature properties. The alloys are fabricable into wrought articles by casting, deforming, and annealing for sufficient time to provide ordered structure.

11 Claims, 5 Drawing Figures

DUCTILE LONG RANGE ORDERED ALLOYS WITH HIGH CRITICAL ORDERING TEMPERATURE AND WROUGHT ARTICLES FABRICATED THEREFROM

BACKGROUND OF THE INVENTION

This invention was made in the course of, or under, a contract with the United States Department of Energy. It relates in general to long range ordered alloys of the transition metals V, Ni, Co, and Fe and more specifically to long range ordered alloys of the $AB_3$ type.

Long range ordered alloys are like intermetallic compounds whose atoms are arranged in order below a critical ordering temperature, $T_C$. The term "long range order" refers to alloys having ordered structure extending for a distance of more than 100 atoms in a single domain. The principle advantage of long range ordered alloys is their strength and stability in use environments at high temperatures. At temperatures below $T_C$ the ordered structure of the alloy has the lowest free energy. An ordered alloy can experience temperatures below $T_C$ for indefinite periods without undergoing significant compositional or phase changes. Above $T_C$, the tensile strength of ordered alloys is substantially reduced due to the disordering effect.

In the prior art the principal disadvantage associated with long range ordered alloys has been their extreme brittleness. As a result long range ordered alloys are not used as structural material for high temperature applications.

Long range ordered alloys have been found in the V—Co—Fe system. The crystal structure of an alloy of the composition $V(Fe_{0.17}, Co_{0.83})_3$ is described in an article entitled "Influence of Radius Ratio on the Structure of Intermetallic Compounds of the $AB_3$ Type" by Van Vucht in *J. Less-Common Metals,* 11, (1966) 308–322. The structures of alloys of the compositions $V(Fe_{0.3}, Co_{0.7})_3$, $V(Fe_{0.1}, Co_{0.9})_3$ and $V(Fe_{0.03}, Co_{0.97})_3$ are described in an article entitled "Close-Packed Ordered $AB_3$ Structures in Ternary Alloys of Certain Transition Metals" by Sinha, in *Transactions of the Metallurgical Society of AIME,* 25, May, 1969, 911–917. Apparently neither author studied the mechanical properties of the cast alloys and it can be presumed that the alloys were thought to be excessively brittle as are other ordered alloys of the $AB_3$ structure. Additionally, neither author described the effect of Fe content on $T_C$.

SUMMARY OF THE INVENTION

It is an object of this invention to provide a novel malleable alloy composition having a high critical ordering temperature, high strength and ductility at room and elevated temperatures and excellent creep resistance while in the ordered state. It is a further object to provide a novel use of certain long range ordered alloys in a fabrication method which employs their newly discovered properties in the ordered state to provide wrought articles having excellent mechanical properties and stability at high temperatures. It is a further object to provide an improvement in an apparatus having a component exposed to a temperature of greater than 300° C.

In its composition aspects, this invention comprises a long range ordered alloy composition having a critical ordering temperature greater than 850° C., a room temperature ultimate tensile strength greater than 900 MPa, and a room temperature tensile elongation greater than 20%, said alloy composition having the nominal $V(Fe, Co)_3$ or $V(Fe, Co, Ni)_3$ composition with an electron density no greater than 7.85 and comprising by weight 22–23% V, 14–30% Fe, and the remainder Co or Co and Ni. The maximum combination of high temperature stability, strength, and ductility occurs in the alloy comprising by weight 22–23% V, 14–20% Fe, and the remainder Co, or Co and Ni with excellent properties occurring at the composition by weight of 22–23% V, 16–17% Fe and the remainder Co, or Co and Ni.

In its method aspects, this invention comprises a method of fabricating wrought articles from a long range ordered alloy comprising by weight 22–23% V, 14–30% Fe and the remainder Co or Co and Ni and having the nominal $V(Fe, Co)_3$ or $V(Fe, Co, Ni)_3$ composition with an electron density no greater than 7.85, said method comprising the steps of (a) deforming said alloy at a temperature either above or below the critical ordering temperature of said alloy to provide a wrought article; and (b) annealing said wrought article for sufficient time to provide long range ordered structure in said wrought article.

Because of the excellent strength and ductility of the alloy in its ordered state, the deformation process can be performed at temperatures below the critical ordering temperature.

In its article aspects, this invention comprises a wrought article of manufacture in the form of sheet, wire, foil and the like having the long range ordered alloy compositions of this invention.

In its apparatus aspects, this invention comprises an improvement in apparatus having a component exposed to a temperature greater than 300° C. in which said component comprises the alloy compositions of this invention.

DETAILED DESCRIPTION

Figure 1:
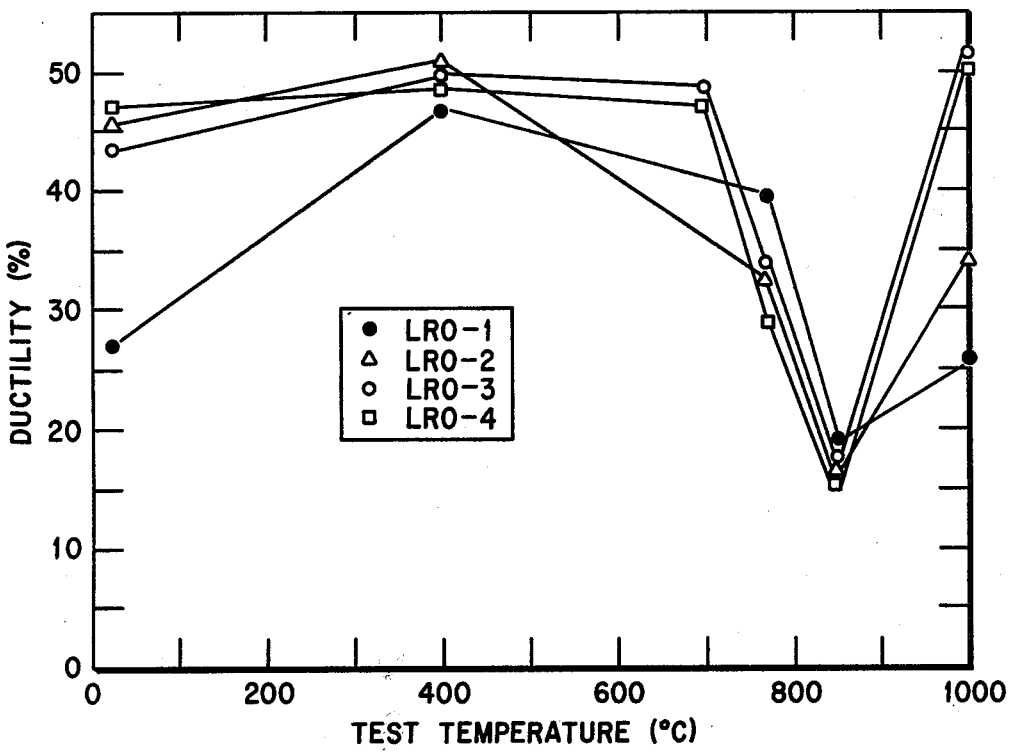
FIG. 1 is a graph of ductility as a function of temperature for wrought alloys of this invention.

One aspect of this invention is the discovery that the excessive brittleness in ordered $AB_3$ type alloys in the V—Co and V—Co—Ni system is alleviated by the presence of sufficient Fe to provide an electron density no greater than 7.85. The electron density (e/a) is the number of electrons outside the inert gas shell, i.e. 4s and 3d electrons, per atom. At electron densities below 7.85 alloys in the $V(Fe, Co)_3$ and $V(Fe, Co, Ni)_3$ system exhibit face centered cubic structure. At electron densities greater than 7.85 the ordered alloys have significantly lower ductility, particularly at room temperature.

The alloys of this invention demonstrate a highly desirable combination of high tensile strength, high yield strength, good tensile elongation, low evaporation losses, coupled with no brittle phase formation at elevated temperatures. The alloy composition comprising by weight 22–23% V, 14–30% Fe, and the remainder Co or Co and Ni with e/a no greater than 7.85 has a critical ordering temperature greater than 850° C., a room temperature ultimate tensile strength of greater than 900 MPa and a room temperature tensile elongation greater than 20%. The alloy composition comprising by weight 22–23% V, 14–20% Fe and the remainder Co has a tensile elongation greater than 35% at 770° C. The exceptional ductility by comparison with other long range ordered alloys enables the alloys to be used in conventional metalworking fabrication methods such as rolling, drawing, forging, swaging etc., followed by annealing for sufficient time to provide long range ordered structure characteristic of the alloy composition. The resulting wrought articles, such as sheet, wire, foil and the like have excellent stability and can be further fabricated into desired configurations by conventional metalworking techniques, including deformations performed below the $T_C$ of the alloy composition. In view of the prior art's belief that long range ordered alloys of the $AB_3$ type were excessively brittle, the high ductility of the alloys of this invention was totally unexpected and surprising. It is this unexpected ductility which enables the ordered alloys of this invention to be fabricated at temperatures below $T_C$.

The unexpected ductility and high temperature strength of the wrought ordered alloys of this invention make them useful in high temperature applications. The alloys of this invention are particularly useful as structural material for components of apparatus which are exposed to temperatures in excess of 300° C., for example, in closed cycle energy systems such as high temperature gas-cooled reactors, space power systems, magnetic fusion reactors, and fast breeder reactors which require high strength and creep resistance at elevated temperatures.

The maximum high temperature properties are presently thought to occur in alloys consisting essentially of the specified transition metals, however it is probable that additional components will be found that further enhance the properties of the alloys. "Consisting essentially of" is defined to include only those components which do not materially affect the strength and ductility of the alloy in its ordered state. The alloys of this invention may consist of V, Co, Fe, and Ni in the specified proportions. The maximum combination of high temperature properties occurs in the $V(Fe_{0.20-0.26}, Co_{0.74-0.80})_3$ composition having the composition by weight of 22–23% V, 14–20% Fe and the remainder Co. Excellent high temperature properties are demonstrated by the alloy comprising 22–23% V, 16–17% Fe, and the remainder Co.

It has been found that a portion of the Co content of the alloys of this invention may be replaced by Ni without significantly affecting the mechanical properties as compared to the V—Fe—Co alloy. This V—Fe—Co—Ni alloy is particularly useful in components, such as nuclear reactor fuel cladding, etc., which are exposed to a neutron flux sufficient to cause measurable activation of Co. The maximum amount of Ni which can be present is a function of the Fe composition since the electron density must be no greater than 7.85.

The alloy compositions of this invention are most easily prepared by first melting the appropriate mixture of metals by conventional techniques and casting into an ingot. The melting can be performed by any conventional metallurgical technique, with arc-melting and drop-casting being preferred.

The cast alloy is then worked by conventional techniques, with hot rolling being preferred. It is generally preferred that the alloys of this invention be worked at temperatures above $T_C$ because of good fabricability. After working, the alloys of this invention are annealed for sufficient time to provide long range ordered structure, with 1–5 hours at 700°–800° C. being generally sufficient.

Table I depicts the $T_C$, e/a, and structure for several atomic compositions of V, Co, Ni and Fe. The corresponding compositions by weight are presented in Table II. Increasing Fe concentration is accompanied by a reduction in electron density and critical ordering temperature. As the Fe concentration enters the 14–30 wt.% range represented by alloys LRO-1 through LRO-4, the structure changes from hexagonal close pack to cubic.

TABLE I

| Alloy | Atomic Composition | $T_C$, ° C. | e/a | Structure* |
|---|---|---|---|---|
| LRO-O | $V(Co_{0.43}, Ni_{0.57})_3$ | 1020 | 8.428 | HCP |
| LRO-1 | $V(Fe_{0.22}, Co_{0.78})_3$ | 960 | 7.835 | FCC |
| LRO-2 | $V(Fe_{0.3}, Co_{0.7})_3$ | 920 | 7.775 | FCC |
| LRO-3 | $V(Fe_{0.333}, Co_{0.667})_3$ | 880 | 7.750 | FCC |
| LRO-4 | $V(Fe_{0.4}, Co_{0.5}\ Ni_{0.1})_3$ | 860 | 7.775 | FCC |
| LRO-5 | $V(Fe_{0.15}, Co_{0.85})_3$ | ~975 | 7.888 | HCP & FCC |

*HCP = hexagonal; FCC = Face centered cubic

TABLE II

| Alloy | Composition (wt %) | | | |
|---|---|---|---|---|
| | V | Fe | Co | Ni |
| LRO-0 | 22.5 | 0 | 34.5 | 43.0 |
| LRO-1 | 22.57 | 16.33 | 61.1 | 0 |
| LRO-2 | 22.65 | 22.34 | 55.01 | 0 |
| LRO-3 | 22.68 | 24.83 | 52.49 | 0 |
| LRO-4 | 22.75 | 29.92 | 39.47 | 7.86 |
| LRO-5 | 22.51 | 11.10 | 66.39 | 0 |

EXAMPLE

Alloys LRO-1 through 4 were prepared by first melting appropriate amounts of V, Fe, Co, and Ni melting stock by electron-beam melting to minimize metallic and interstitial impurities. The mixed metals were arc-melted six times, then drop-cast into 2.5 × 1.3 × 14 cm. ingots. The ingots were cut into halves for cold and hot fabrications. The cold fabrication schedule involved heating the cut ingots in a helium atmosphere for 10–15 minutes at 1100°–1150° C., then water quenching. The quenched ingots, having a $R_C$ hardness of 10–20, were cold rolled at room temperature with 5–10% reduction per pass until the hardness reached 35–38 $R_C$. LRO-1 and LRO-2 cracked upon cold rolling but LRO-3 and LRO-4 were fabricated into 0.76-mm thick sheet without difficulty. The hot fabrication process involved wrapping the cut ingots in Mo sheet and rolling at 1000°–1050° C. in air with about 20% reduction per pass. After a total of 80% reduction in thickness, the alloys were re-wrapped in Mo plate and rolled to 0.76 mm. at 1050° C. with a 10% reduction per pass. The final sheets had good quality with no indication of edge or end cracks. Vacuum fusion and carbon analyses indicated that the alloys contained about 100 ppm O, C, and N.

To determine the ordering kinetics and structure, fabricated sheets of LRO-1 through LRO-4 were first annealed at 1050°-1100° C. for about 10 min., followed by quenching to provide a disordered state. The quenched specimens were then aged in vacuum for different periods at 700°-800° C. X-ray diffraction studies indicate that ordering is nearly complete after one hour aging at 700° C. The cubic ordered structure ($AuCu_3$-type) is apparently the stable ordered phase in these alloys since no further structure change is observed upon up to 300 hours aging at 700° C. Consequently, 1-5 hours at 700°-800° C. is sufficient to provide long range ordered structure in the wrought alloys of this invention.

Table III depicts the mechanical properties of the alloys of this invention as compared to LRO-5 containing less than 14 wt.% Fe.

TABLE III

| Test Temp. (° C.) | Yield Strength (MPa) | Tensile Strength (MPa) | Elongation (%) |
|---|---|---|---|
| | | LRO-1 | |
| Room Temperature | 337.6 | 990.7 | 26.0 |
| 400 | 329.3 | 1333.9 | 46.7 |
| 770 | 378.3 | 915.7 | 39.3 |
| 850 | 438.9 | 662.8 | 19.0 |
| 1000 | 205.3 | 219.1 | 25.6 |
| | | LRO-2 | |
| Room Temperature | 315.2 | 1326.0 | 47.2 |
| 400 | 322.5 | 1231.9 | 50.4 |
| 770 | 374.1 | 777.2 | 32.1 |
| 850 | 430.6 | 573.9 | 16.3 |
| 1000 | 141.3 | 149.5 | 34.5 |
| | | LRO-3 | |
| Room Temperature | 377.6 | 1221.6 | 43.5 |
| 400 | 428.6 | 1377.3 | 50.1 |
| 700 | 461.6 | 1145.1 | 48.6 |
| 770 | 476.1 | 855.1 | 33.4 |
| 850 | 511.9 | 587.0 | 17.1 |
| 1000 | 101.3 | 110.2 | 51.3 |
| | | LRO-4 | |
| Room Temperature | 373.4 | 1205.8 | 46.9 |
| 400 | 439.6 | 1364.2 | 48.9 |
| 700 | 467.1 | 1036.3 | 46.8 |
| 770 | 499.5 | 757.9 | 28.7 |
| 850 | 513.3 | 561.5 | 15.4 |
| 1000 | 83.4 | 87.5 | 50.2 |
| | | LRO-5 | |
| Room Temperature | 421.1 | 656.6 | 7.8 |
| 400 | 376.9 | 1442.8 | 43.6 |
| 770 | 424.4 | 815.1 | 25.6 |
| 850 | 426.1 | 601.5 | 11.1 |
| 1000 | 129.5 | 132.3 | 30.8 |

LRO-5 exhibits very poor ductility at room temperature. LRO-1 possesses the maximum combination of mechanical properties particularly at temperatures above 700° C. LRO-2, which contains more Fe than LRO-1, has significantly lower strength and ductility at high temperatures.

Table IV depicts the minimum creep rate and rupture life of LRO-1 and LRO-2 compared with Hastelloy X.

TABLE IV

| Alloy | Minimum Creep Rate (cm./cm./hr.) | Rupture Life (hr) |
|---|---|---|
| LRO-1[a] | $1.7 \times 10^{-4}$ | 470 |
| LRO-2[a] | $3.0 \times 10^{-4}$ | 67 |
| H-X[a] | $17 \times 10^{-4}$ | 99 |
| LRO-1[b] | $4 \times 10^{-6}$ | — |
| LRO-3[b] | $6 \times 10^{-6}$ | — |
| H-X[b] | $1000 \times {}^{-6}$ | 110 |

[a]871° C and 10 ksi (68.9 MPa) in vacuum
[b]760° C and 20 ksi (137.8 MPa) in vacuum Hastelloy X, a Ni-base alloy containing 18.5% Fe, 2.5% Co, 21.8% Cr, 9% Mo, 0.6% W, 1% Si, 1% Mn and 0.15% C, is generally used as a structural material below 800° C. As shown in Table IV the rupture life of LRO-1 is dramatically superior to either Hastelloy X or LRO-2 at 871° C., and both LRO-1 and LRO-3 have creep rates two orders of magnitude lower than Hastelloy X at 760° C.

Figure 2:
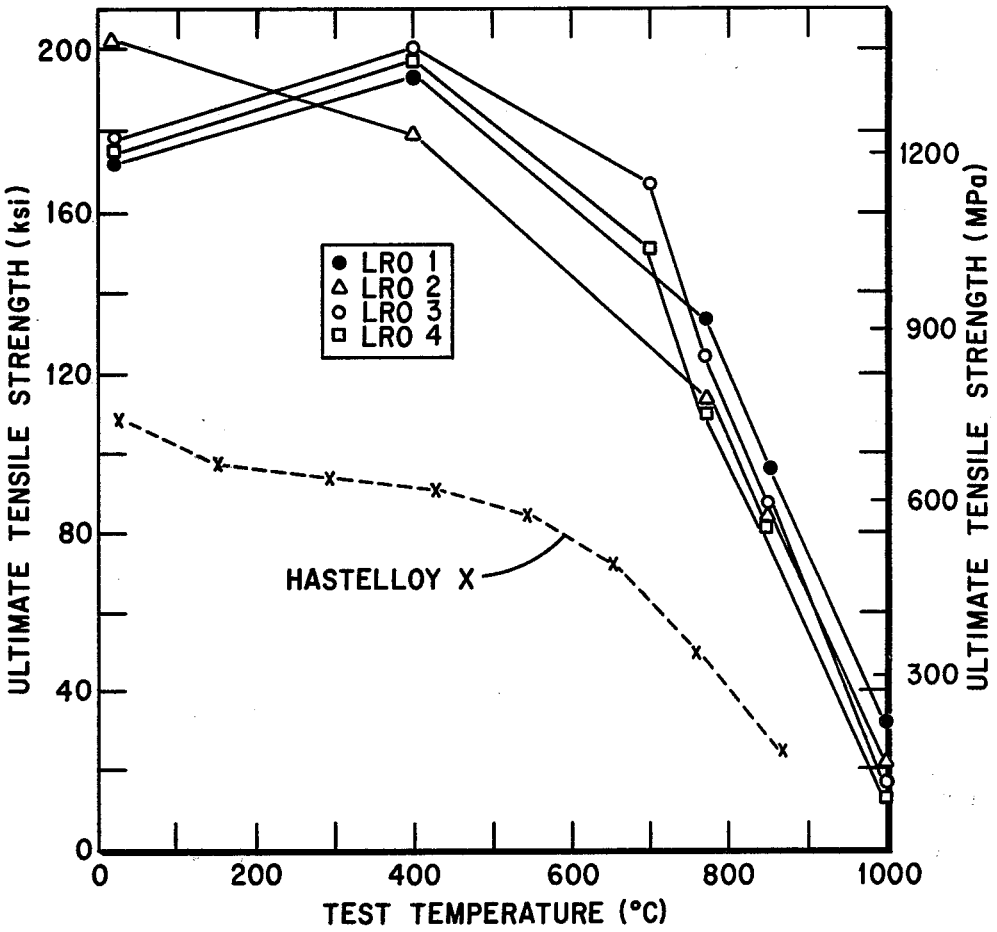
FIG. 2 is a graph of ultimate tensile strength as a function of temperature for wrought alloys of this invention and for Hastelloy X.
Figure 3:
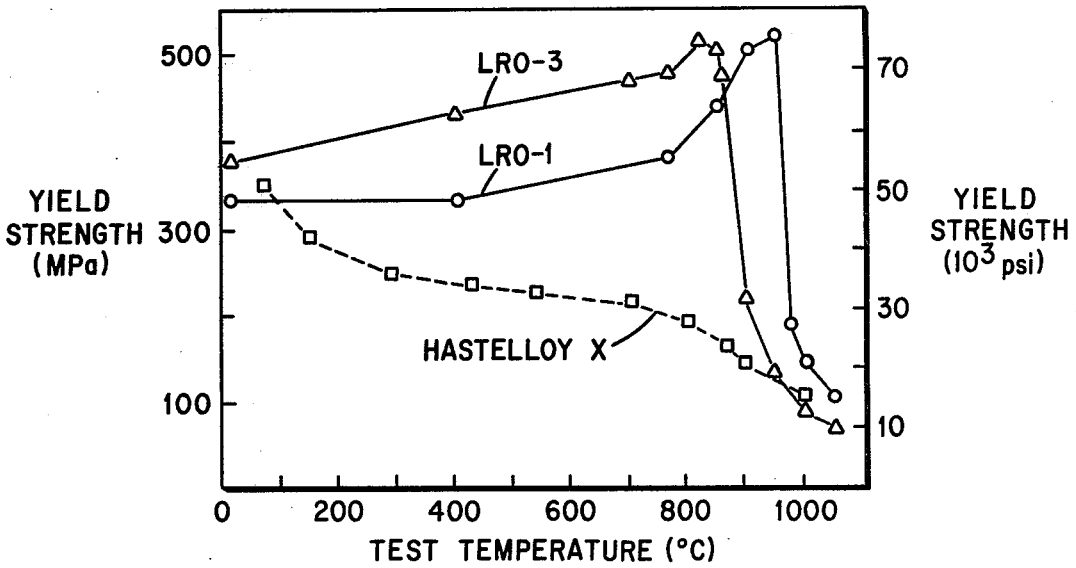
FIG. 3 is a graph of yield strength as a function of temperature for wrought alloys of this invention, and for Hastelloy X.

FIGS. 1, 2 and 3 depict the high temperature properties of LRO-1 in comparison with alloys LRO-2, LRO-3, and LRO-4. As seen in FIG. 1 the ductility of LRO-1 becomes significantly superior in the range of about 750°-850° C. As shown in FIG. 2 the tensile strength of LRO-1 becomes significantly greater at temperatures above 750° C. Each of the LRO alloys in their ordered state is substantially superior to Hastelloy X. At 800° C., the ultimate tensile strength of the ordered alloys is more than 2½ times that of Hastelloy X. FIG. 3 depicts the yield strength of LRO-1 compared to LRO-3 and Hastelloy X. The yield strength of the ordered alloys increases with temperature up to near $T_C$ due to ordering effects. Hastelloy X demonstrates a marked decline in tensile strength at elevated temperatures. At temperatures above 850° C. LRO-1 becomes significantly superior in yield strength to LRO-2.

Figure 4:
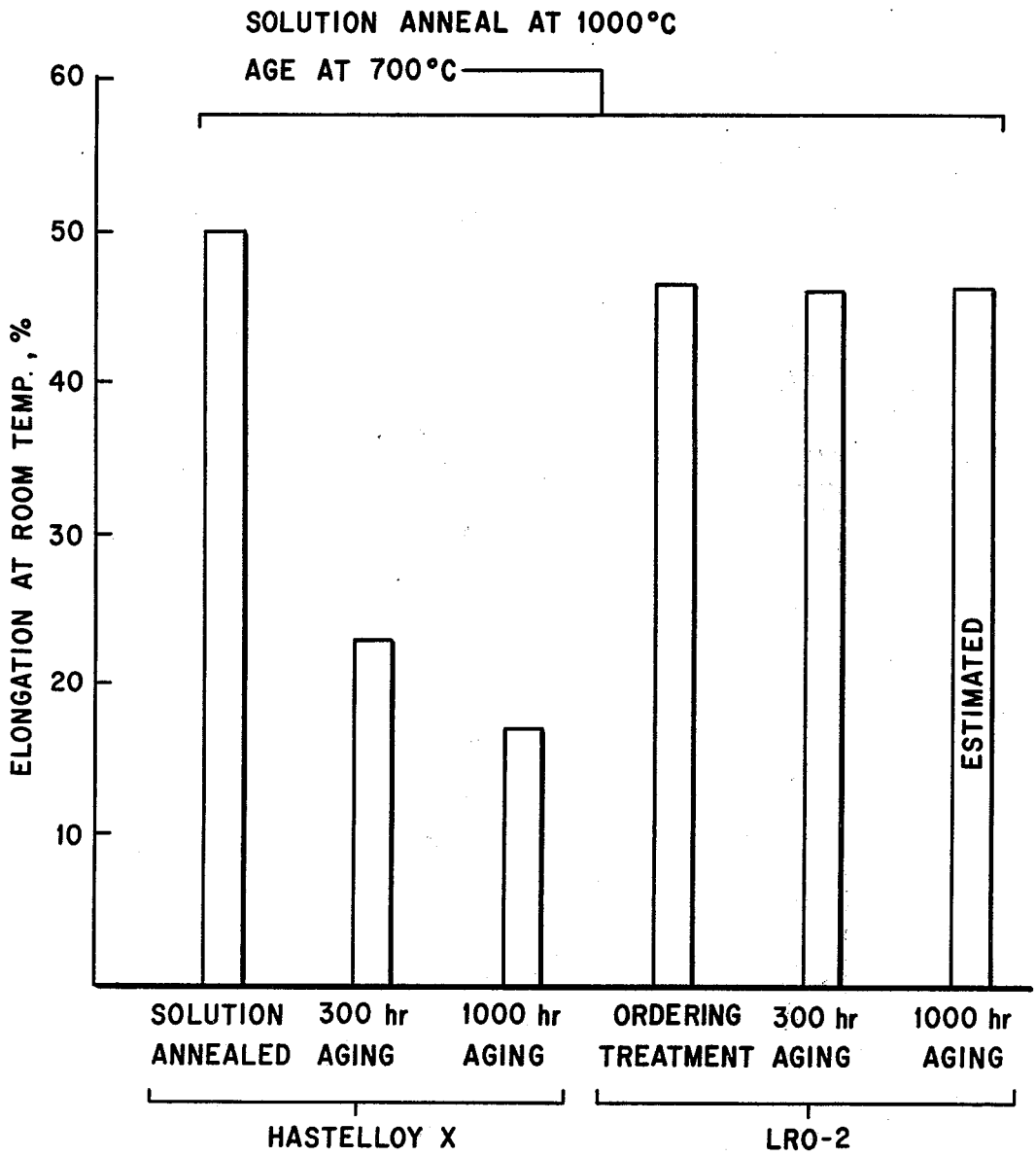
FIG. 4 is a histogram demonstrating the effect of aging on an alloy of this invention as compared to Hastelloy X.

FIG. 4 illustrates the stability of the ordered alloys of this invention compared to Hastelloy X. Prior to testing, LRO-2 was quenched from 1100° C. and annealed for one hour at 700° C. to bring the ordered structure into equilibrium. Hastelloy X showed a significant reduction in ductility on aging while LRO-2 showed essentially no reduction in ductility at room temperature after 300 hours of aging with no change in ductility expected after 1000 hours. The striking stability of ductility illustrates the absence of brittle phase formation upon aging of alloys of this invention.

Figure 5:
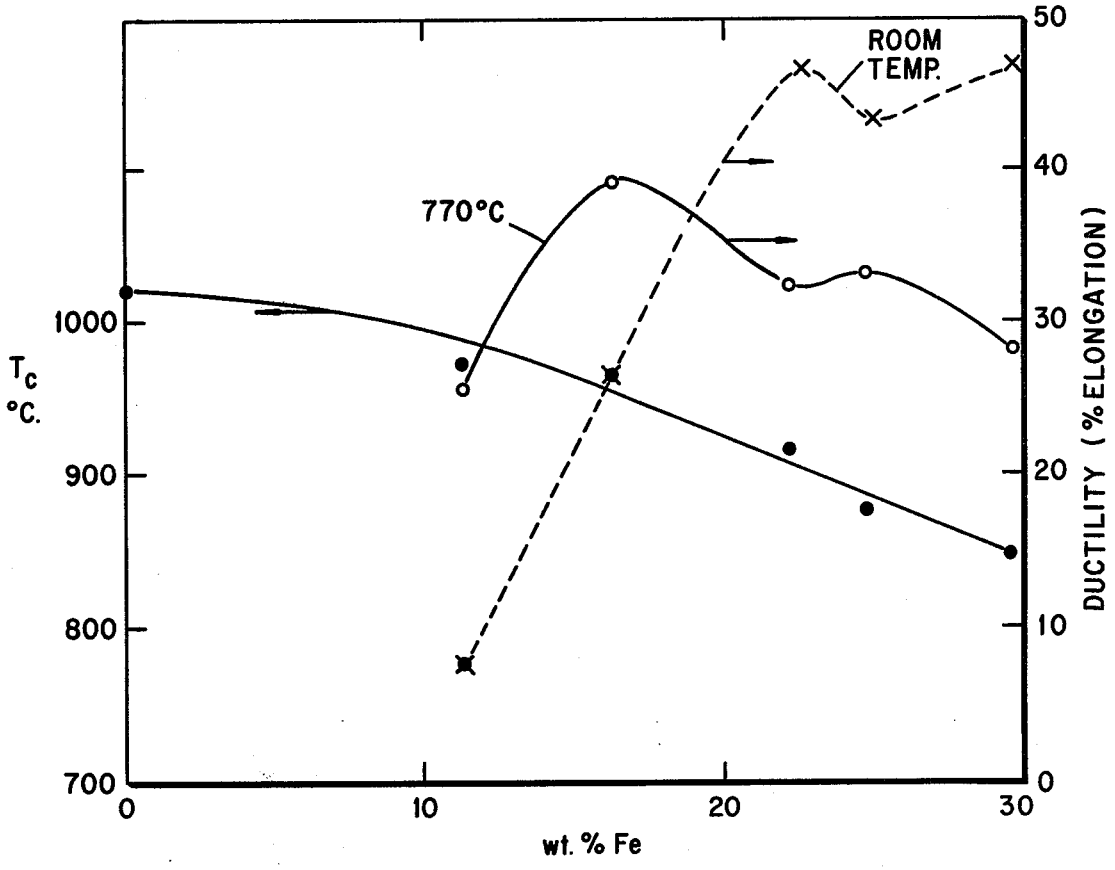
FIG. 5 is a graph of critical ordering temperatures and tensile elongation at 770° C. and room temperature as a function of Fe composition for ordered alloys in the $V(Fe, Co)_3$ and $V(Fe, Co, Ni)_3$ system.

FIG. 5 depicts the critical ordering temperature and tensile elongation at room temperature and at 770° C. as a function of iron composition. The ductility dramatically increases with iron content above about 11% and is relatively insensitive to additional iron above 20%. The critical ordering temperature decreases with increasing iron content, providing the maximum combination of ductility, high-temperature strength and high critical ordering temperature in the composition range of about 14-20 wt.% iron. This corresponds to the atomic composition $V(Fe_{0.20-0.26}, Co_{0.74-0.80})_3$ or the composition by weight of 22-23% V, 14-20% Fe and the remainder Co, where the tensile elongation at 770° C. is about 35% or more.

What is claimed is:

1. A long range ordered alloy composition having a critical ordering temperature greater than 850° C., a room temperature ultimate tensile strength greater than 900 MPa, and a room temperature tensile elongation greater than 20%, said alloy having the nominal $V(Fe, Co)_3$ or $V(Fe, Co, Ni)_3$ composition and comprising by weight 22-23% V, 14-30% Fe, and the remainder Co, or Co and Ni with an electron density no greater than 7.85.

2. The ordered alloy composition of claim 1 consisting essentially of by weight 22–23% V, 14–30% Fe, and the remainder Co or Co and Ni.

3. The ordered alloy composition of claim 1 comprising by weight 22–23% V, 14–20% Fe, and the remainder Co or Co and Ni.

4. The ordered alloy composition of claim 1 consisting essentially of by weight 22–23% V, 14–20% Fe, and the remainder Co or Co and Ni.

5. The ordered alloy composition of claim 1 comprising by weight 22–23% V, 16–17% Fe, and the remainder Co or Co and Ni.

6. The ordered alloy composition of claim 1 consisting essentially of by weight 22–23% V, 16–17% Fe, and the remainder Co or Co and Ni.

7. The ordered alloy composition of claim 1 comprising by weight 22–23% V, 14–20% Fe, and the remainder Co and having a tensile elongation at least 35% at 770° C.

8. A wrought article of manufacture in the form of sheet, wire, foil, and the like having the composition of claim 1, 3, or 5.

9. In an apparatus having structural component exposed to a temperature greater than 300° C., the improvement in which said component comprises the alloy of claim 1, 3 or 5.

10. A method for fabricating articles from the alloy of claim 1, 3, or 5 comprising deforming said alloy at a temperature above the critical ordering temperature of said alloy to provide a wrought article and annealing said wrought article for sufficient time to provide long range ordered structure in said wrought article.

11. A method for fabricating articles from the alloy of claim 1, 3, or 5 comprising deforming said alloy at a temperature below the critical ordering temperature of said alloy to provide a wrought article and annealing said wrought rticle for sufficient time to provide long range ordered structure in said wrought article.

* * * * *